United States Patent [19]

Beaty, Sr.

[11] Patent Number: 4,576,509

[45] Date of Patent: Mar. 18, 1986

[54] SECURITY GATE

[76] Inventor: John E. Beaty, Sr., 107 Miami Gardens Rd., Hollywood, Fla. 33023

[21] Appl. No.: 651,328

[22] Filed: Sep. 17, 1984

[51] Int. Cl.[4] ..... E01F 13/00

[52] U.S. Cl. ..... 404/6; 404/11; 49/49

[58] Field of Search ..... 404/6, 11, 10, 9; 49/9, 49/33, 49, 131, 386; 256/13.1, 1, 64, 26, DIG. 2; 52/64; 14/1, 31, 32, 36, 53, 60, 68, 69.5, 71.5, 71.1, 71.3; 188/32; 244/110 R

[56] References Cited

U.S. PATENT DOCUMENTS

| | | | |
|---|---|---|---|
| 1,033,214 | 7/1912 | Tolson | 49/33 |
| 1,949,295 | 2/1934 | Dean | 404/11 |
| 2,105,857 | 1/1938 | Derby | 404/11 |
| 2,741,859 | 4/1956 | Castle | 49/49 |
| 3,089,267 | 5/1963 | Wooden | 256/1 X |
| 3,626,638 | 12/1971 | Lafferty | 49/49 |
| 3,775,912 | 12/1973 | Walls | 49/131 |
| 3,805,448 | 4/1974 | Carr et al. | 49/49 |
| 4,101,235 | 7/1978 | Nelson | 404/6 |
| 4,152,871 | 5/1979 | Kardash, Jr. | 49/49 |
| 4,354,771 | 10/1982 | Dickinson | 404/6 |
| 4,490,068 | 12/1984 | Dickinson | 404/11 |

*Primary Examiner*—Stephen J. Novosad
*Assistant Examiner*—Matthew Smith
*Attorney, Agent, or Firm*—Oltman and Flynn

[57] ABSTRACT

A crash resistant vehicle barrier that can be opened to pass traffic and closed to bar traffic even if the vehicle crashes into the barrier. The barrier is pivotable about a horizontal axis in the roadway into and out of a pit below the roadway. The barrier includes a counterweight for ease of operation.

8 Claims, 5 Drawing Figures

SECURITY GATE

BACKGROUND OF THE INVENTION

The invention relates to security gates and more particularly to crash proof security gates.

There has in recent years been an increasing number of cases wherein terrorists have attacked military, government and industrial organizations by crashing a vehicle at high speed through barriers and gates erected at security entrances.

Inventors have in the past sought solutions for providing crash-resistant security barriers and gates.

U.S. Pat. No. 4,354,771 discloses a curb barrier with retractable curb modules.

U.S. Pat. No. 4,152,871 discloses a vehicle barricade with a barrier plate that can be raised or lowered with hydraulic pressure.

U.S. Pat. No, 4,101,235 discloses an exit control device having a barrier of retractable sharp spikes in the roadway.

U.S. Pat. No. 3,805,448 discloses a vehicle traffic control apparatus having pivotal plates that can be hydraulically raised from the road surface.

U.S. Pat. No. 3,775,912 discloses an automatically operated vehicle gate with a locking mechanism.

U.S. Pat. No. 3,626,638 discloses a wrong-way traffic safety barrier consisting of retractable barrier elements in the road surface.

U.S. Pat. No. 3,089,267 discloses a pushover gate that can be opened by pressure from a motor vehicle but is resistant to livestock.

With increasing militancy shown in recent years by terrorists in many parts of the world it appears that none of the prior art teaches a vehicle barrier of high crashworthiness when attacked by a heavy vehicle moving at high speed against the barrier.

SUMMARY OF THE INVENTION

The instant disclosure addresses the problem of stopping a heavy vehicle approaching a security gate at high speed for the purpose of crashing it. It is therefore an object of the instant disclosure to provide a very strong crash-resistant vehicle barrier.

It is a further object to provide a barrier that can readily be opened for traffic that is to be allowed through the gate.

It is a still further object to provide a barrier that is highly visible and clearly shows an approaching vehicle driver that there is a barrier ahead of him.

The instant invention, accordingly, provides a barrier element of heavy and strong construction that is installed in a passageway such that the barrier is pivotable about a horizontal axis in the roadway, and equipped with suitable operating elements for raising and lowering the barrier. The barrier is displayed by raising it to a vertical position in which it projects upward from the road surface, so that it is clearly visible. The barrier is deactivated by being lowered into a coordinated pit in the roadway so that an allowed vehicle can pass smoothly over the backside of the barrier, which in the lowered position, is flush with the roadway. When the barrier is raised, the pit in the roadway is filled with an angled section of the barrier which pivots up from below the roadway to fill the surface opening of the pit to prevent persons from falling into the open pit. The angled part further has a low barrier strip that comes up at the front edge of the pit when the barrier is raised to prevent a vehicle from driving onto the angled part, which would prevent the barrier from being lowered. The pivotable barrier advantageously has counterweights to ease the operation of the heavy barrier components.

DETAILED DESCRIPTION OF THE PREFERRED EMBODIMENTS

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

Figure 1:
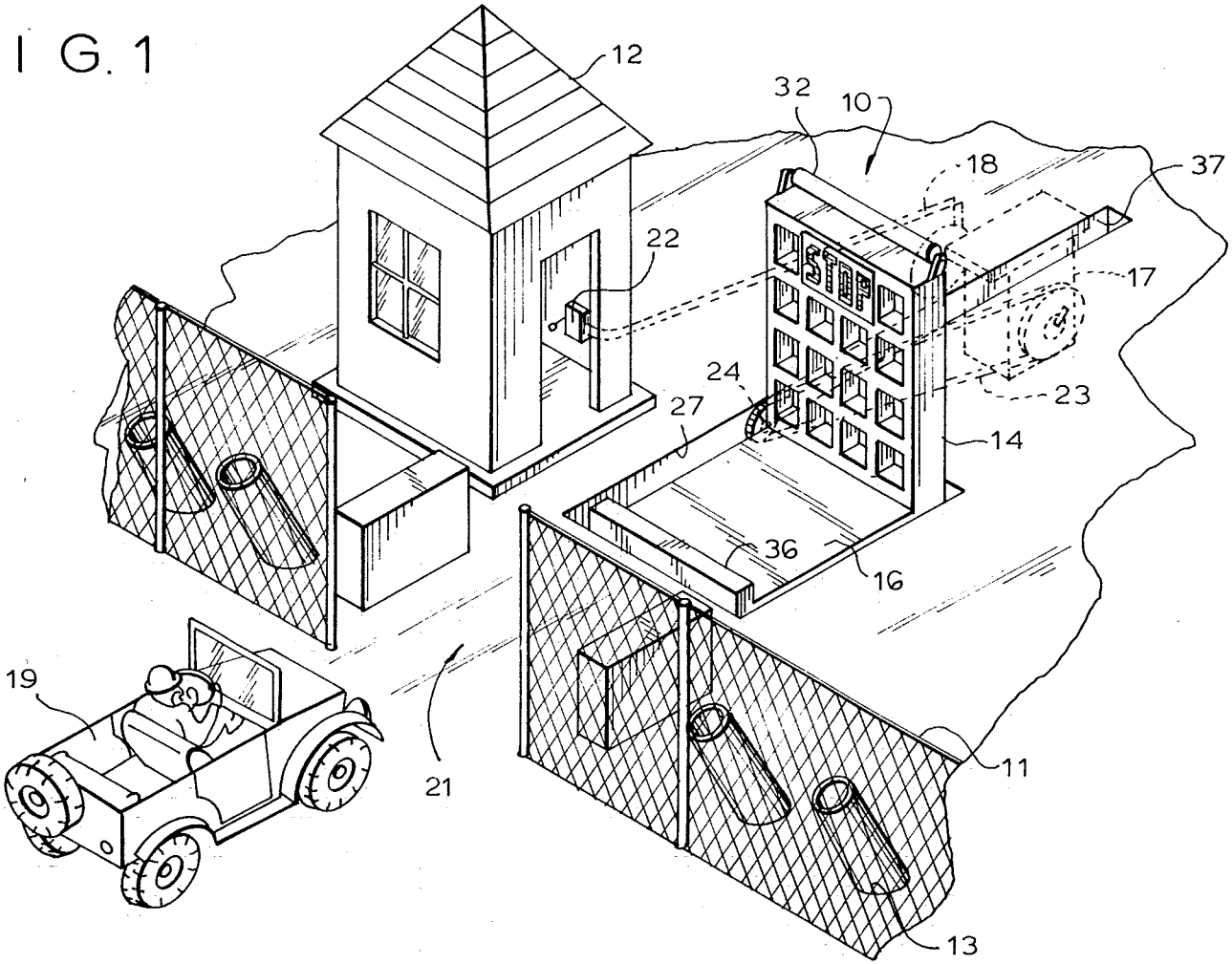
FIG. 1 is a perspective view of a security gate having a reinforced fence with a gate entrance leading to the security barrier shown in its raised position, next to a guard house and details of the operating mechanism.

FIG. 1 is a security entrance of a typical configuration with a fence 11 in front of protective abutments 13, a guard house 12 and a vehicle 19 entering an entrance 21. A security barricade generally at 10, shown in its active position has an upstanding vertical generally planar rectangular barrier 14 of a sturdy construction that is strong enough and has sufficient mass to stop even a heavy vehicle entering the entrance 21 at a high speed for the purpose of crashing through the gate.

The upstanding barrier 14 is rigidly connected to a perpendicular surface member 16 also of a generally planar rectangular construction having generally the same outline dimensions as the barrier 14.

The security gate 10, consisting of the barrier 14 and the surface member 16 is pivotable as a unitary element about a horizontal axis 24 (FIGS. 2 and 3) disposed in a line defined by the intersection of the two perpendicular planes defined by the upstanding barrier 14 and the surface member 14.

Figure 3:
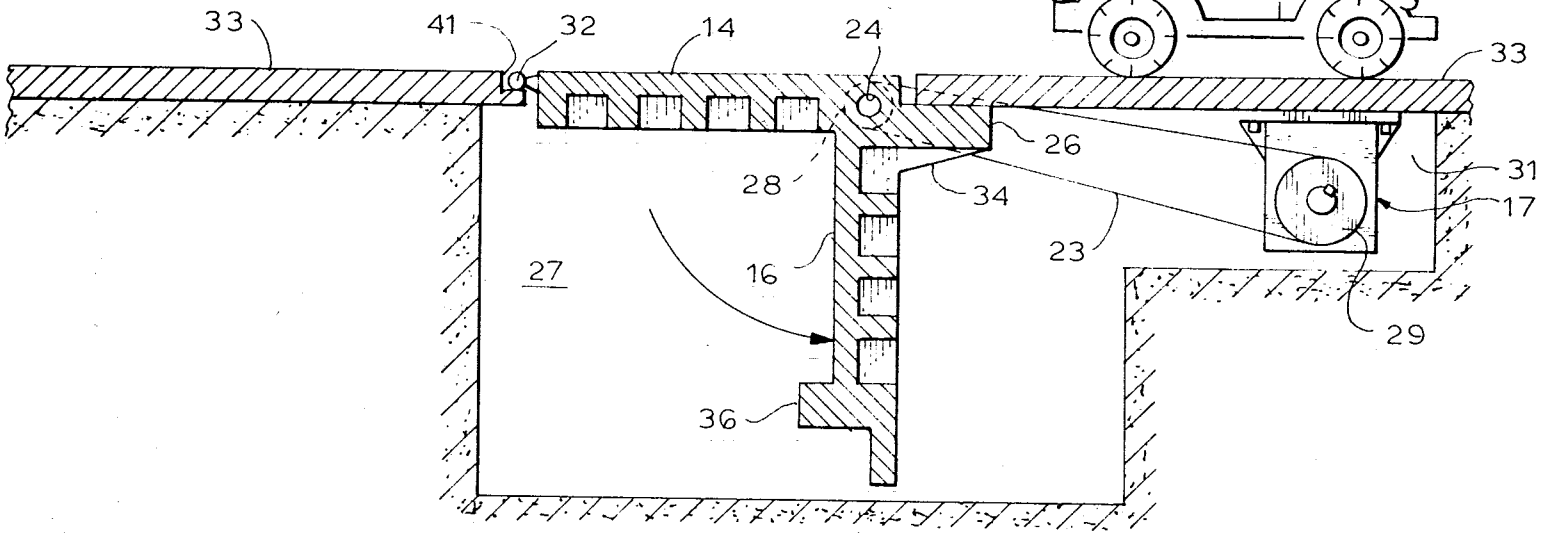
FIG. 3 is an elevational, cross-sectional side view similar to FIG. 2 but showing the barrier lowered with its backside filling the pit opening and flush with the road surface, so that a vehicle can drive over it.
Figure 4:
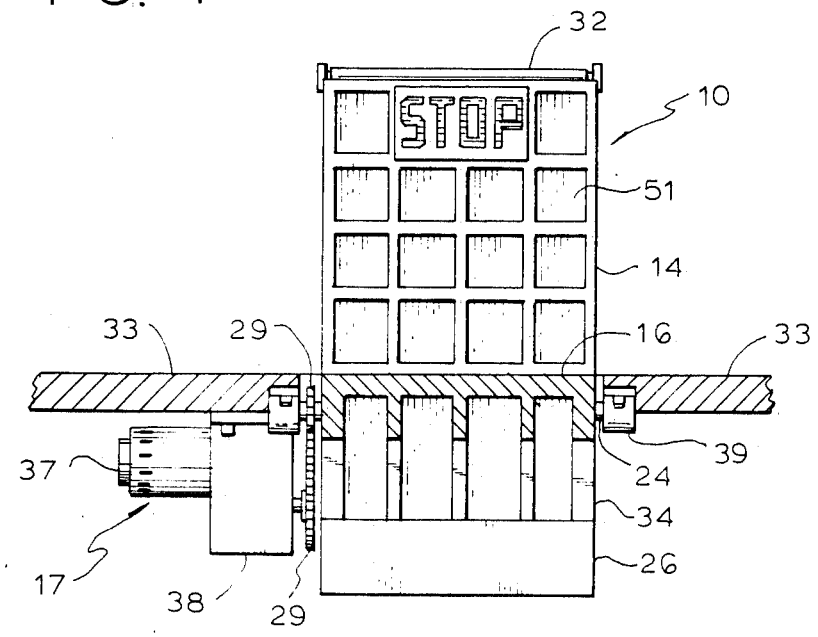
FIG. 4 is an elevational, part cross-sectional front view of the barrier in its raised position with details of the operating apparatus and a counterweight, taken along the line 4—4 of FIG. 2.

The axis 24, which is not shown in FIG. 1, as seen in FIGS. 3 and 4 and is advantageously disposed slightly below the ground level.

The security gate 10 is pivotable between an upper active position shown in FIG. 1 and a lower inactive position in which the barrier is pivoted down into its lower inactive horizontal position seen in FIG. 3. The security gate is operated between these positions by means of an activator 17 connected by a chain drive 23 to the security gate 10. The activator 17 is controlled by a control switch 22 in the guard house 12, via control lines 24.

Figure 2:
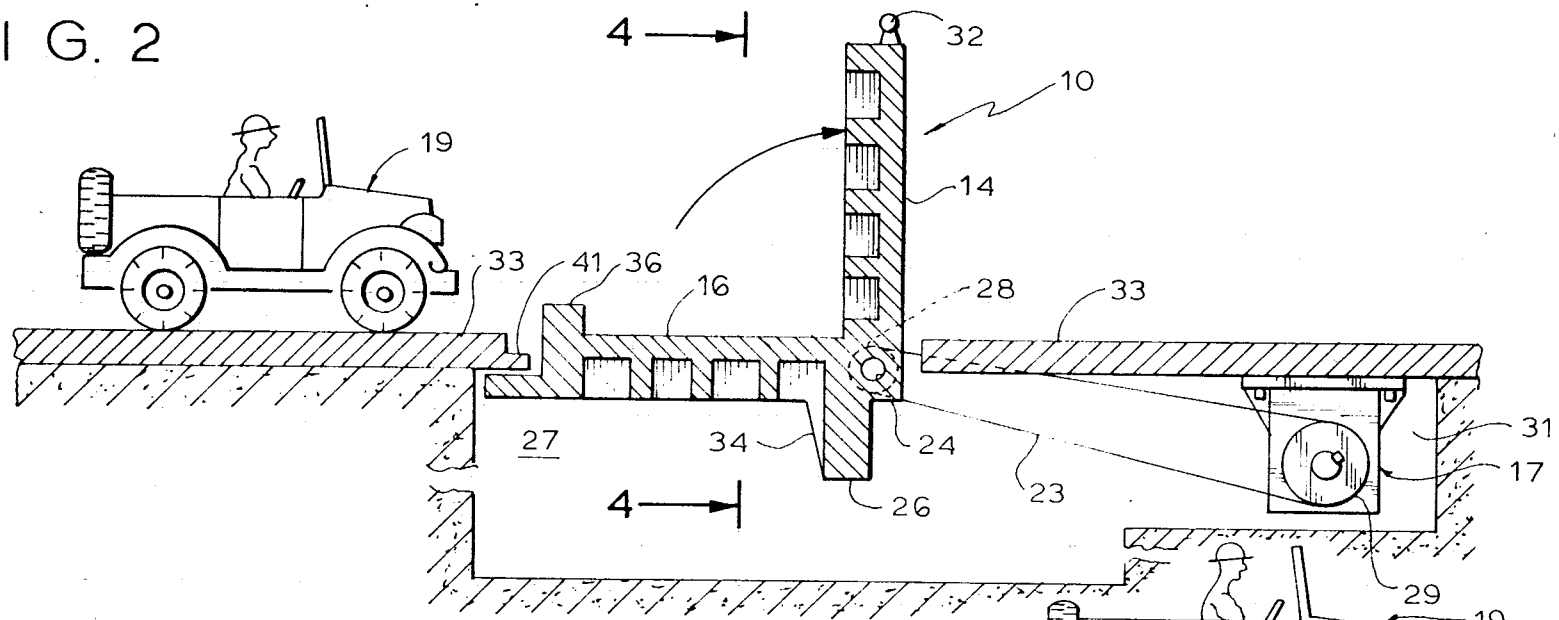
FIG. 2 shows an elevational, cross-sectional side view through the barrier components with the barrier raised and the angled part filling the pit opening, and a barrier curb blocking the access to the pit opening.

FIGS. 2 and 3 are vertical, cross-sectional diagrammatic views of the security gate 10 shown in its upper position in FIG. 2 and in its lower position in FIG. 3.

FIG. 2 is a cross-section of the emergency gate 10 and the surface member 16, pivotably attached to the horizontal axis 24 to which a driven sprocket wheel 28, facing away from the viewer, shown in phantom lines, is attached. A vertically downward projecting counterweight 26 is attached to a vertical arm 34 and serves to counteract the weight of the upstanding barrier 14 and the surface member 16 so that they can be more readily rotated by the actuator 17.

The entire pivotable assembly, constituting the emergency gate 10, is installed over an underground pit 27 that provides space for the counterweight 26 when the gate is in its upper position as seen in FIG. 2, and for surface member 16 when the gate is in its lower position, seen in FIG. 3.

In FIG. 2, the surface member 16 is seen filling the opening of the pit 27, and in this position it serves to prevent pedestrians from inadvertently falling into the pit.

A curb 16 is attached, vertically upstanding, to the front edge of the surface member 16 and serves to stop an approaching vehicle 19 that might inadvertently or deliberately move beyond the edge of the pavement 33 and thereby interfere with the operation of the security gate 10.

The actuator 17 is advantageously an electric motor installed in a smaller pit 31 which may be connected with the larger pit 27 by a trench 37, best seen in FIG. 1, for accommodating the drive chain 23 connecting the actuator 27 with the security gate 10. The actuator 17 is seen bolted upside down to the underside of the pavement 33. However, it follows that the actuator may as well be installed above the pavement or in any other suitable location, as long as a mechanical drive train can be provided between the security gate 10 and the actuator 17.

Furthermore, the drive train, shown for example as a drive chain 23 between a driving sprocket wheel 29 and a driven sprocket wheel 28, may as well be constructed in any other suitable way, such as a rotating shaft, as a push-pull rod or in any other suitable manner.

A horizontal roller 32 at the leading edge of the barrier 14 serves to fill the crack between the pavement 33, and the barrier 14, when it is in its lower position.

In its lower position, shown in FIG. 3, the backside of the security barrier 14 becomes part of and flush with the pavement 33 and fills the opening of the pit 27. The barrier is constructed to be strong enough to carry the weight of a vehicle 19 travelling over it.

The roller 32 may advantageously fit in a coordinated recess 41 so that the roller with its supports may contribute to carry the weight of the vehicle 19 when it is atop the barrier 14. Instead of a roller 32, the barrier may have a lip, seen on FIG. 5, which registers with the recess 41 and serves to support the weight of the barrier 14 and a load on its backside.

FIG. 4 is an elevational part cross-sectional view of the security gate 10 in its upper position, seen along the line 4—4 of FIG. 2 and showing details of the actuator 17, consisting of an electric motor 37 attached to a reduction gear assembly 38, which serves to reduce the high RPM of the motor 37 to a low rotational speed of the security gate 10 when it has been rotated.

Figure 5:
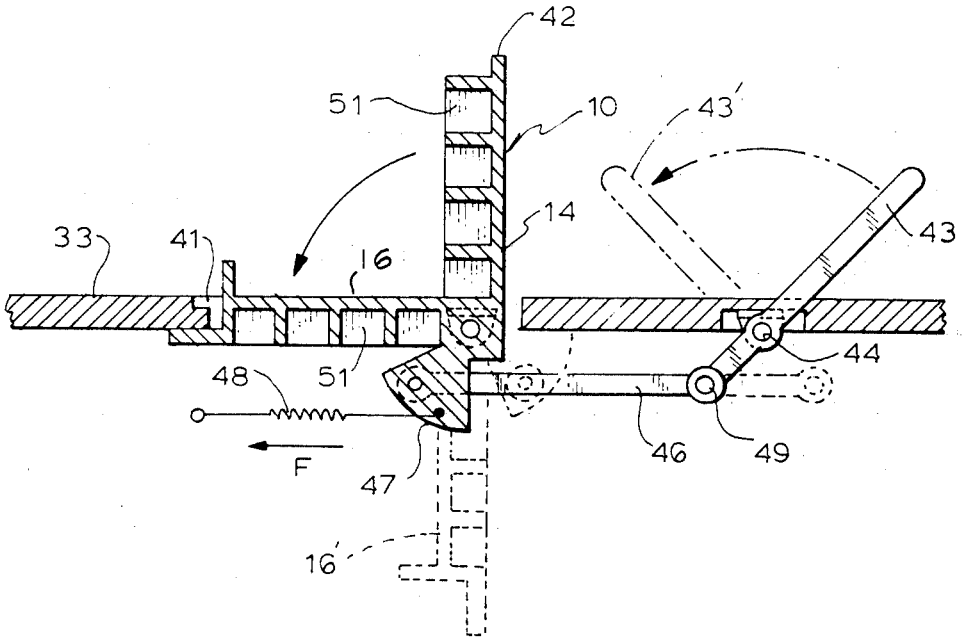
FIG. 5 is an elevational cross-sectional side view of the invention showing the barrier in raised position and details of its manually operating apparatus.

FIG. 5 is a side elevational view of a security gate in an embodiment that is suitable for smaller installations in which a manually operated lever 43 may be used to operate the security gate 10, optionally in combination with an actuator 17 as shown in FIG. 4 or manual operation alone. The manual lever 43 is pivotable about a fulcrum 44 and engages at its lower end a pushrod 46 in a pivot point 49. The barrier 14 is shown in its upper position, and the hand lever 43 is shown in its corresponding position in full lines and in phantom lines 43', indicating its position corresponding to the barrier being in its down position.

A downward projecting counterweight 47 also serves as an attachment point for an optional spring 48 exerting a horizontal force in the direction of the arrow F, which may be used to provide additional countervailing moment for raising the barrier 14 from its lower to its upper position.

The construction of the barrier 14 and the surface member 16 is shown to have a "honey comb" structure consisting of cells 51 facing leftward (or downward), respectively. Such a construction affords a high degree of strength without undue increase in weight when applied to planar construction elements, as is well known. It follows that other types of construction may be used, such as longitudinal ribs or braces, as well as a hollow or solid construction.

FIG. 4 shows the vertical barrier 14 carrying a conspicuous highly visible STOP sign for warning an approaching driver. FIG. 5 also shows an upward facing lip 42 along the upper edge of the barrier which is coordinated with the recess 41 in the pavement 33 for supporting the barrier 14 in its lower position.

FIG. 4 shows two anti-friction bearings 39 for supporting the shaft 24 that in turn carries the weight of the security gate 10.

The barrier and the surface element may advantageously be made from reinforced concrete, but may be made of any other suitable strong material, such as steel, wood or combinations thereof.

I claim:

1. A security gate for a vehicular driveway consisting of two sections of pavement spaced apart by an opening, the security gate comprising:

a substantially planar barrier having a straight horizontal pivot axis disposed substantially at a right angle to the direction of the driveway and at a level no higher than the surface of the pavement, the barrier pivotably supported at said pivot axis between an upper vertical postion with a side facing and for stopping approaching traffic and a lower position in which it fills the opening for providing a driving surface flush with the pavement;

a substantially planar surface element disposed perpendicularly to said barrier and rigidly attached thereto along said pivot axis, the surface element substantially congruent with said opening and operating to fill the opening when said barrier is in its upper position;

said barrier and said surface element providing an L-shaped structure having an open side above said surface element and in front of said barrier, so that a vehicle crashing into said barrier rests on said surface element and the weight of the vehicle counteracts the force of the vehicle crashing into the barrier;

a pit below the opening for receiving the surface element when the barrier is in its lower position;

means for rotating said barrier with the surface element between its upper vertical and its lower horizontal position;

means for pivotably supporting the barrier with the surface element along said pivot axis.

2. A security gate according to claim 1 wherein said means for rotating the barrier comprises:

a motor;

a chain-type drive train engaging said motor at one end and said security gate at the other for rotating the barrier about said pivot axis between the lower and the upper position.

3. A security gate according to claim 2 further comprising a reduction gear interposed between said motor drive train for reducing the speed of rotation of said barrier.

4. A security gate according to claim 3 wherein said drive train comprises: a driving sprocket wheel and a chain therebetween.

5. A security gate according to claim 1 and further comprising at least one lip projecting away from said pivot axis, said lip coordinated with a corresponding recess in the pavement for receiving said lip, the lip serving to partially support the weight of the barrier when the barrier is in its lower position.

6. A security gate according to claim 1 and further comprising a counterweight, the counterweight projection extending away from said barrier in the direction from said pivot axis for partially counteracting the rotary moment about said pivot axis created by the weight of said barrier.

7. A security gate according to claim 1 and further comprising a spring engaging at one end said counterweight for providing a spring force further counteracting the rotary moment created by the weight of said barrier and said surface element.

8. A security gate according to claim 1 wherein said security gate further comprises a hand lever for manually rotating the barrier.

* * * * *